US008927928B2

(12) United States Patent
Decker et al.

(10) Patent No.: US 8,927,928 B2
(45) Date of Patent: Jan. 6, 2015

(54) METHOD FOR OPERATING A TIME-OF-FLIGHT MASS SPECTROMETER WITH ORTHOGONAL ION PULSING

(75) Inventors: Petra Decker, Bremen (DE); Oliver Räther, Lilienthal (DE)

(73) Assignee: Bruker Daltonik GmbH, Bremen (DE)

( * ) Notice: Subject to any disclaimer, the term of this patent is extended or adjusted under 35 U.S.C. 154(b) by 0 days.

(21) Appl. No.: 13/465,669

(22) Filed: May 7, 2012

(65) Prior Publication Data

US 2012/0280118 A1 Nov. 8, 2012

(30) Foreign Application Priority Data

May 5, 2011 (DE) ..... 10 2011 100 525

(51) Int. Cl.
*H01J 49/40* (2006.01)
*H01J 49/00* (2006.01)

(52) U.S. Cl.
CPC ..... *H01J 49/0031* (2013.01)
USPC ..... 250/287; 250/281; 250/282

(58) Field of Classification Search
USPC ..... 250/281, 282, 286, 287
See application file for complete search history.

(56) References Cited

U.S. PATENT DOCUMENTS

| | | | | |
|---|---|---|---|---|
| 5,689,111 | A | 11/1997 | Dresch et al. | |
| 6,111,250 | A | 8/2000 | Thomson et al. | |
| 6,507,019 | B2 | 1/2003 | Chernushevich et al. | |
| 6,794,604 | B2 | 9/2004 | Herke et al. | |
| 6,900,430 | B2 | 5/2005 | Okumura et al. | |
| 7,164,125 | B2 | 1/2007 | Weiss et al. | |
| 7,391,021 | B2 | 6/2008 | Stoermer et al. | |
| 7,582,864 | B2 | 9/2009 | Verentchikov | |
| 2008/0156980 | A1 * | 7/2008 | Rather et al. | 250/287 |
| 2009/0294642 | A1 * | 12/2009 | Brown | 250/282 |
| 2011/0226943 | A1 | 9/2011 | Räther | |
| 2012/0085905 | A1 | 4/2012 | Satoh | |

FOREIGN PATENT DOCUMENTS

| | | |
|---|---|---|
| EP | 1315195 | 5/2003 |

OTHER PUBLICATIONS

GB Office Action.

* cited by examiner

*Primary Examiner* — Nicole Ippolito
(74) *Attorney, Agent, or Firm* — O'Shea Getz P.C.

(57) ABSTRACT

Methods are provided for acquiring sum spectra in a time-of-flight mass spectrometer with orthogonal pulsed acceleration, where each of the sum spectra is obtained from a plurality of summed individual spectra. The mass spectrometer has an ion storage device that collects the ions temporarily before they are transferred to an ion pulser, which pulses out the ions orthogonally. Acquisition conditions such as, for example, delay times between opening the ion storage device and the pulsed ejection in the ion pulser are varied for the individual spectra, which are added together to form the sum spectrum of ions with light masses and high masses.

11 Claims, 4 Drawing Sheets

METHOD FOR OPERATING A TIME-OF-FLIGHT MASS SPECTROMETER WITH ORTHOGONAL ION PULSING

PRIORITY INFORMATION

This patent application claims priority from German Patent Application No. 10 2011 100 525.4 filed on May 5, 2011, which is hereby incorporated by reference in its entirety.

FIELD OF THE INVENTION

The present invention relates generally to mass spectrometry and, more particularly, to aquiring sum spectra in a time-of-flight mass spectrometer with pulsed acceleration of ions orthogonal to a previous direction of flight (OTOF-MS), where the sum spectra is provided from a plurality of summed individual spectra.

BACKGROUND OF THE INVENTION

The term "mass" is used below to refer to a "charge-related mass" m/z, which is a physical measure, measured by any type of mass spectrometry. The term "mass" therefore does not refer to a "physical mass" m unless clearly indicated otherwise. The dimensionless number z represents a number of excess elementary charges on an ion; e.g., the number of electrons or protons of the ion that are effective externally as ion charge. Thus, the charge-related mass m/z is a mass fraction per elementary ion charge. The terms "light ions" and "heavy ions" are used below to respectively describe ions with low and high charge-related masses m/z. The terms "mass spectrum" and "mass discrimination" relate to the charge-related masses m/z. The terms "dalton" or "Da" describe a mass unit as well as a charge-related mass unit because a dalton is non-coherently assigned to the officially adopted International System of units (SI).

A time-of-flight mass spectrometer in which a primary ion beam undergoes pulsed acceleration at right angles to the original direction of flight of ions is referred to as an orthogonal time-of-flight mass spectrometer (OTOF-MS). FIG. 1 schematically illustrates a simplified embodiment of such an OTOF mass spectrometer 100. An ion pulser 12 is included in a mass analyzer of the mass spectrometer 100 at a first end of the flight path 13. The mass analyzer accelerates a section of the primary ion beam 11, for example a string-shaped ion packet, into the flight path 13 at right angles to the previous direction of the beam 11. This process provides a ribbon-shaped secondary ion beam 14 that includes individual, transverse, and string-shaped ion packets. Each of the string-shaped ion packets includes ions of equal mass. The string-shaped ion packets that include light ions fly relatively quickly, whereas the string-shaped ion packets that include heavier ions fly relatively slowly. The direction of flight of the ribbon-shaped secondary ion beam 14 lies between the previous direction of the primary ion beam 11 and the direction of acceleration at right angles because the ions retain speed in the original direction of the primary ion beam 11. The time-of-flight mass spectrometer 100 preferably includes a velocity-focusing reflector 15 to reflect the whole width of the ribbon-shaped secondary ion beam 14 with the string-shaped ion packets, focuses velocity spread of the beam 14, and directs beam 14 towards a flat detector 16.

The ion pulser 12 may operate with repetition frequencies between five and thirty kilohertz (kHz). Thus, between 5,000 and 30,000 individual spectra per second may be acquired, and summed in real time over a predetermined time span between about one twentieth of a second and twenty seconds to form a sum spectrum. This provides the sum spectra with a high dynamic measurement range, even where relatively few ions are measured in each individual spectrum. To scan substance peaks that separate in liquid chromatographs or capillary electrophoresis devices, the individual spectra are typically summed over a time span of one second to form a sum spectrum.

Today, time-of-flight mass spectrometers with orthogonal ion acceleration typically no longer use a continuous ion beam with ions flowing without interruption into the ion pulser. Rather, the ions are typically first collected in an ion storage device to increase the mass spectrometer sensitivity. U.S. Pat. No. 5,689,111 discloses such an ion storage device for an OTOF-MS.

The ion storage device 7 of FIG. 1 is an RF multipole rod system (e.g., a quadrupole rod system) terminated at its ends with aperture lenses 6 and 9. The ion storage device 7 is surrounded by an insulating casing that is filled with collision gas by the gas feeder 8 such that the ions in the interior thereof practically come to rest after a short damping period. The ions are extracted from the ion storage device 7 with low kinetic energy by switching a potential at the extraction lens 9, which directs the ions as a fine ion beam 11 to the ion pulser 12. The ions of the ion beam 11 fly through the pulser 12 with a uniform, relatively low kinetic energy of between about 15 and 20 electron volts. The relatively slow-flying ions are pulsed out of the ion pulser 12, using high acceleration voltages perpendicular to the previous direction of flight of the ions, into the flight path 13 of the time-of-flight mass spectrometer 100.

As the ions are extracted from the ion storage device 7 and transferred into the ion pulser 12, some mass separation takes place because, on the one hand, the light ions fly faster at an equal kinetic energy while, on the other hand, the light ions may be extracted faster from the ion storage device 7. The light ions therefore arrive at the ion pulser 12 first, and their density inside the pulser 12 decreases dramatically because the main bunch of the light ions extracted first from the storage device 7 has already left the ion pulser 12. The heavier ions reach the ion pulser 12 once the number of light ions in the ion pulser 12 has already greatly decreased. The number of heavier ions in the ion pulser 12 also passes through a relative maximum and then decreases again. The composition of the ions in the ion pulser 12 regularly changes until the pulsed ejection.

The time at which the pulsed ejection takes place determines the composition of the ions in the individual spectrum measured, which results in mass discrimination. Typically, as the number of ions of a specific mass in the ion pulser 12 increases, the lower the kinetic energy of the ions becomes because the ions fly more slowly, which increases the mass discrimination. Part of the mass discrimination occurs because the path between the multipole ion storage device 7 and the ion pulser 12 is not arbitrarily short for a variety of reasons; another part of the mass discrimination is generated while the ions are being extracted from the ion storage device. The ion storage device 7 is usually closed again shortly before the ion pulser 12 ejects the next pulse.

The ion storage device 7 includes collision gas for the purpose of collision focusing and to damp ion motion as effectively as possible. The ions thus collect in a relatively motionless state in the axis of the ion storage device 7. The ions therefore may be taken from the ion storage device 7 relatively easily and with relatively little energy spread. The ion pulser 12, in contrast, is configured in a region with a relatively strong vacuum to prevent the ions from colliding with residual gas molecules. The ions therefore typically pass through several differential pumping stages between the ion storage device 7 and the ion pulser 12. FIG. 1 illustrates, for example, an arrangement of einzel lens 10 mounted into a wall between two pump stages. The transfer of the ions from the annular extraction aperture 9 of the ion storage device 7 to the ion pulser 12 takes place in the ion beam 11 by free flight with relatively little collisions. The distance between the extraction lens 9 and a center of the ion pulser 12 may be between about five to eight centimeters.

The formation of the fine ion beam 11 is particularly important for the mass resolving power of the time-of-flight analyzer. The ion beam 11 should be a parallel beam of small diameter with slow ions of uniformly low energy (e.g., around fifteen electron volts). The fine ion beam 11 is formed where ion motion in the ion storage device 7 is effectively damped and electrical perturbations that may affect the quality of the ion beam 11 are reduced (e.g., minimized). Such electrical perturbations may be caused by switching the potential of the extraction lens 9, or residual fringe fields of the RF voltage at the ion storage device 7.

An example of mass discrimination between different ionic species as described above is graphically illustrated in FIG. 2 as a function of time. The curves in FIG. 2 are derived from measurements of the spectra of a mixture of substances whose masses range from m=78 Da to m=2722 Da, where singly charged ions (z=0) were evaluated. The spectra was measured, for example, for ionic species with 78, 118, 322, 622, 922, 1222, 1522, 1822, 2122, 2422 and 2722 dalton. The mass spectra were acquired with different time delays between the opening of the extraction lens 9 and the pulsing of the ion pulser 12; e.g., the time delays ranged from about 8 to 190 microseconds. From the spectra, the characteristics of the intensities of the different ionic species were generated as a function of the delay time and are normalized to the maximum in each case. The measurements show that a mass spectrum which is acquired with a delay time of 10 microseconds only measures ions of the mass m=78 u; i.e., there are no ions with higher masses in the mass spectrum. If one acquires a mass spectrum with a longer delay time, however, some ions with lower masses are contained, but only with low intensity. For example, with a delay of around 160 microseconds, the ions of all masses may be measured simultaneously, but not all with maximum sensitivity; e.g., the light ions have already dropped to around five percent of their maximum value.

Time-of-flight mass spectrometers of the type of FIG. 1 may be used in protein analysis. In peptide or protein analyses with electrospray ionization, multiply charged ions may be produced; e.g., the ions of the charge level with the largest number of ions may usually be found in the range of 900 Da<m/z<1500 Da, even if the proteins have a high mass m of several thousand daltons. The ions of proteins of high mass appear predominantly multiply charged, the charge level with the maximum intensity regularly being in the range of 900 Da<m/z<1500 Da. Peptides and proteins therefore may be optimally acquired with a delay time of 100 microseconds because the ions are measured here with more than eighty percent of the maximum intensity that may be achieved by varying the delay time. Thus, these instruments are ideal for this type of analysis. However, if ions with masses m/z>2700 Da are present in the mixture of ions to be analyzed, the ions do not appear in the mass spectrum. Furthermore, the ions of mass m/z=100 Da appear with between five and ten percent of the intensity which they would have with a mass-specific optimum setting.

Adaptation of the delay time is disclosed in U.S. Pat. Nos. 6,507,019 and 6,689,111.

Focusing on one mass range may be disadvantageous for many types of analysis such as, for example, quantitative analyses of protein mixtures where interesting proteins were labeled with "reporter groups". The reporter groups are split off as singly charged ions during the ionization and are used for quantitative measurement. The reporter groups often have masses between m=90 Da and m=120 Da. If the delay time is set to 100 microseconds, the ions of the reporter groups appear with between five and ten percent of their maximum intensity. Since the proteins to be measured quantitatively (and with them the reporter groups) usually occur in low concentrations, they may not be evaluated effectively in the analyses in the vast majority of cases. Methods are therefore being sought in which peptide and protein ions as well as the ions of the reporter groups may be measured with high sensitivity.

Various methods and devices have been developed in an effort to reduce or eliminate mass discrimination. U.S. Pat. No. 6,794,604, for example, discloses a "mass selective ion trap" that first releases heavier ions, and subsequently releases increasingly lighter and lighter ions, where the release times are adjusted so that all the ions reach the ion pulser at the same time. In contrast, E.P. Publication No. 1 315 195, which makes no attempt to eliminate mass discrimination, discloses ions with m/z ratios within a first range are transferred from a selective ion trap to the OTOF for a first individual spectrum, while ions with m/z ratios outside this first range are essentially not transferred to the OTOF. Ions with m/z ratios within a second range are subsequently transferred from a selective ion trap to the OTOF for a second individual spectrum, while ions with m/z ratios outside the second range are essentially not transferred to the OTOF. Thus, in both the '604 patent and the '195 Publication, the term "mass-selective ion trap" is used to describe an ion trap that may mass-selectively eject the ions. Attempts at a mass selective trap fail, however, because the trap unavoidably ejects the ions with a high energy spread of a few tens to a few hundred electron volts because the ions are accelerated with different strengths upon exiting the trap, depending on the randomly prevailing phase of the internal RF field.

U.S. Pat. No. 7,582,864 discloses an RF quadrupole rod system, at the end of which a blocking pseudopotential is created at the exit aperture by a non-balanced RF voltage. By gradually reducing the pseudopotential barrier, first heavy, then lighter and lighter ions are allowed to exit the RF quadrupole rod system. While the damaging influence of the RF field on the exiting ions is smaller, it still interferes enough that the highest possible mass resolution is no longer achieved in the OTOF-MS.

There is a need for a method with which an OTOF-MS may be operated in such a way that, as the sum spectra are being acquired, the ions of several mass ranges of interest may be measured without significant losses; e.g., with relatively high ion yield and with relatively high mass accuracy.

SUMMARY OF THE INVENTION

According to an aspect of the invention, a method invention mixes acquisition conditions such as, for example, delay times for individual spectra of a summation series in such a way that ions in a particular range of light masses and ions in a particular range of high masses are measured. An individual spectrum for ions of light masses, for example, may alternate with an individual spectrum of heavier ions. For the ions of light masses, the sensitivity may increase by a factor of about 5, but for ions of heavier masses, the sensitivity does not decrease complementarily, but may remains just as high as for the sole acquisition of individual spectra of heavier ions.

In some embodiments, a longer series of p mass spectra with a short delay time is acquired for the measurement of light ions, and a shorter series of q mass spectra with a longer delay time for heavier ions. During the acquisition of the p mass spectra of the light ions with a short delay time, the heavier ions continue to gather in the ion storage device. The heavier ions are not lost because the ion storage device is closed again before the heavier ions leave it. The ion storage device may be closed, for example, shortly before the ion pulser is switched. Sufficient numbers of light ions for a spectral acquisition are then present in the ion pulser, but the heavy ions remain in the ion storage device. Once the p mass spectra of light ions have been acquired, relatively few acquisitions of mass spectra of the large masses suffice because their quantity in the ion storage device decreases relatively quickly. It is therefore possible to select p>>q. It is also possible to close the ion storage device again after a short time before ions that are slightly heavier than the ions measured can leave the ion storage device. Few or no light ions may appear in the individual spectra of the heavier ions, however, because their supply is cut off.

If, for example, 90 mass spectra are first acquired with a delay time of 10 microseconds for the measurement of light ions with m/z=100 Da, then a series of 10 mass spectra with a delay time of 100 microseconds for heavier ions in the range 900 Da<m/z<1500 Da, and if this method is cyclically repeated for one second at an acquisition rate of 5 kilohertz, then there is almost no loss in sensitivity for heavy ions in comparison to a method which constantly measures only the heavy ions for one second. The light ions, however, are measured with a large gain in sensitivity which is between, for example, a factor of about 5 and a factor of about 20.

The number p may be selected so that, on the one hand, the collected heavy ions are not lost due to increasing space charge effects, and on the other hand, do not bring the ion detector to its saturation limit. The number q may be selected so that the quantity of heavy ions is (e.g., always) reduced to a sufficient extent.

This method can also be extended to several ranges of light ion masses and, where necessary, and/or to several ranges of heavier ions.

These and other objects, features and advantages of the present invention will become more apparent in light of the following detailed description of preferred embodiments thereof, as illustrated in the accompanying drawings.

DETAILED DESCRIPTION OF THE INVENTION

A method is disclosed that alters acquisition conditions such as, for example, delay times for individual spectra during acquisition of single spectra in a summation series. The alteration is performed to increase (e.g., optimize) measurement sensitivity for ions in certain ranges of light masses and certain ranges of heavy masses. The term "delay time" refers to a time span between opening an ion storage device, by switching the extraction lens, and pulsing of an ion pulser. Other acquisition conditions may also be altered such as, for example, voltage and/or frequency of an RF voltage at the storage device in order to press out the ions from the ions storage. The resulting sum spectrum includes individual spectra alternately acquired with different conditions; e.g., different delay times. The sum spectrum includes shorter or longer series of individual spectra, where each of the series is acquired with a different delay time.

Unexpectedly, altering the acquisition conditions does not create measurable losses for ions with heavy masses, but for ions with light masses a significant gain in sensitivity may be achieved. Where ions from two mass ranges are to be measured, for example, individual spectra for light ions may alternate with individual spectra for heavier ions. A relatively long series of p individual spectra, for example, may first be acquired with a short delay time to increase (e.g., optimize) measurement sensitivity of the light ions, and a relatively short series of q individual spectra may then be acquired with a longer delay time for heavier ions. During the acquisition of the p individual spectra of the light ions, the heavier ions are continuously collected in the ion storage device with relatively little or no measurement losses. The collection of the heavier ions may also accumulate when the ion storage device is closed again shortly before the ion pulser is switched.

Figure 1:
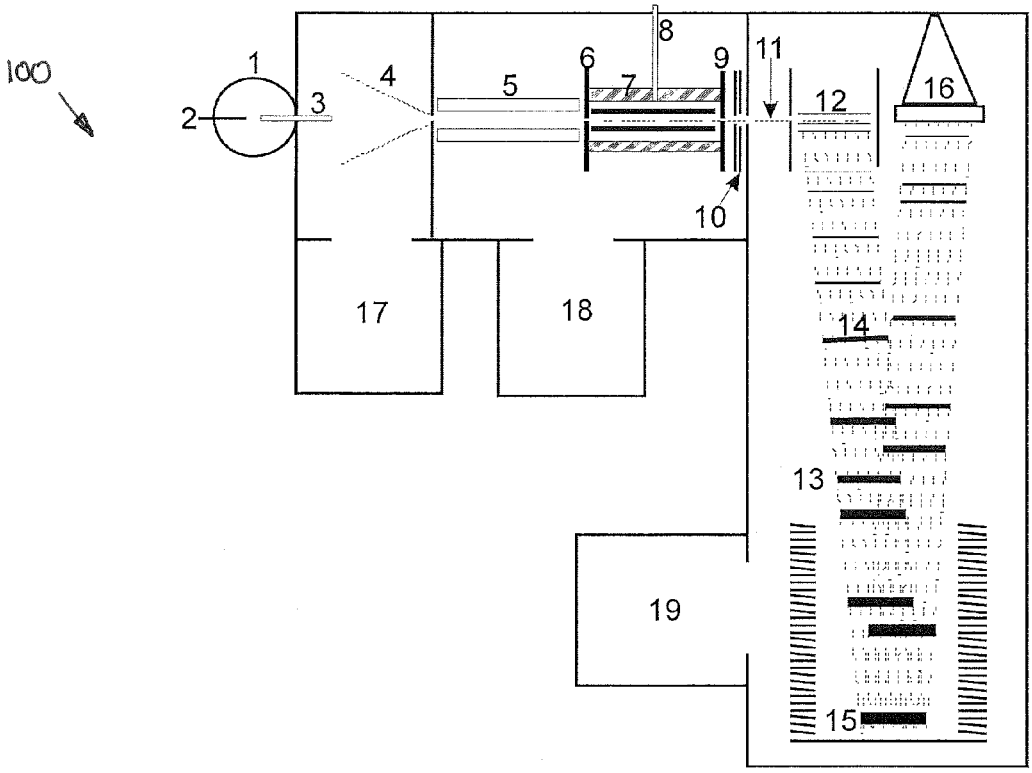
FIG. 1 (PRIOR ART)
FIG. 1 is a schematic illustration of a simplified orthogonal time-of-flight mass spectrometer (OTOF-MS); which can be used for the method disclosed herein. The normal operating mode with temporary storage of the ions in the storage device 7 looks as follows: ions are generated at atmospheric pressure in an ion source 1 with a spray capillary 2; these ions are introduced into the vacuum system through a capillary 3. An ion funnel 4 guides the ions into a first RF quadrupole rod system 5, which can be operated as a simple ion guide, but also as a mass filter to select a species of parent ion to be fragmented. The unselected or selected ions are fed continuously through the ring diaphragm 6 into the storage device 7; selected ions may be fragmented in this process by energetic collisions after suitable acceleration. The storage device 7 has a gastight casing and is charged with collision gas through the gas feeder 8 in order to focus the ions by soft collisions and to collect them in the axis. From the storage device 7, ions are extracted by the switchable extraction lens 9 at specified times; in conjunction with a einzel lens 10, they are shaped into a fine primary beam 11 and sent to the ion pulser 12. The ion pulser 12 pulses out a section of the primary ion beam 11 at right angles into the high-potential drift region 13, thus generating the new ion beam 14. The ion beam 14 is reflected with velocity focusing in reflector 15 and measured in detector 16. The mass spectrometer is evacuated by pumps 17, 18 and 19.
Figure 3A:
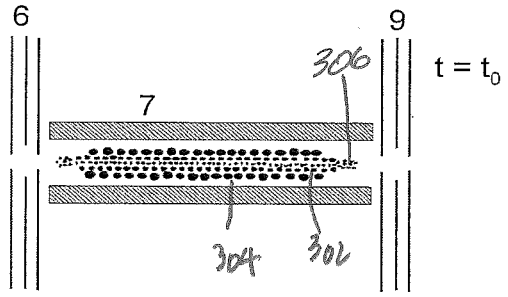
FIG. 3A is an illustration of light, medium and heavy ions in an ion storage device at time ($t_0$) when a switchable extraction lens is opened by switching a potential at a center ring diaphragm.
Figure 3B:
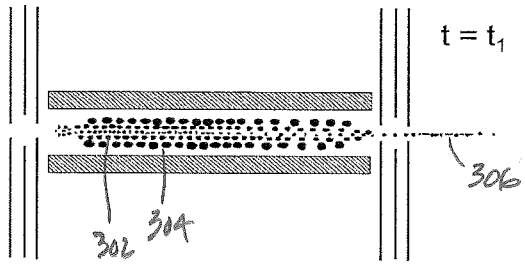
FIG. 3B is an illustration of the ion storage device of FIG. 3A at time ($t_1$) when the light ions are extracted from the storage device through the extraction lens.
Figure 3C:
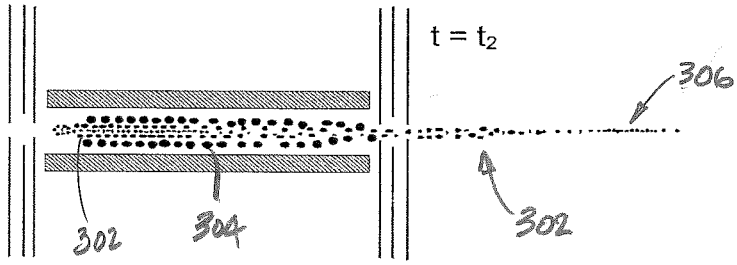
FIG. 3C is an illustration of the ion storage device of FIG. 3A at time ($t_2$) when the medium ions are extracted from the storage device through the extraction lens following the extraction of the light ions.

Referring to FIGS. 3A to 3C, medium and heavier ions 302 and 304 inside the ion storage device 7 typically gather outside the reach of the extracting lens system 9 at least, for example, when lighter ions 306 are present. The lighter ions 306, on the other hand, typically gather nearer to the extraction lens 9, which includes a plurality of ring diaphragms Therefore, a sufficient number of the light ions 306 may be extracted for the acquisition of an individual spectrum before medium-mass ions 302 exit the ion storage device 7. When the voltage at the extraction lens 9 (FIG. 1) is switched, for example, the light ions 306 are the first ions to pass through the extraction lens 9 because the heavier ions 304 move more slowly than light ones in the weak extraction field of the extraction lens 9. In addition, the heavy ions 304 are not only accelerated more slowly by the extraction field of the extraction lens 9, but also decelerated more strongly by friction in the damping gas within the ion storage device 7 (FIG. 1).

A series of p=470 individual spectra may be acquired with a relatively short delay time of, for example, ten microseconds to measure light ions with m/z=100 Da. A series of q=30 individual spectra may subsequently be acquired with a delay time of, for example, one hundred microseconds to measure heavier ions in the range 900 Da<m/z<1500 Da. An optimum number of individual spectra p and q to be acquired may be determined on a case-by-case basis. Where the measurement series are cyclically repeated at an acquisition rate of 5 kilohertz for one second, for example, then there is almost no loss in sensitivity for the heavy ions compared to a method which continuously measures only the heavy ions for one second. The light ions, however, are measured with a large gain in sensitivity, increased by a factor between five and twenty.

Figure 2:
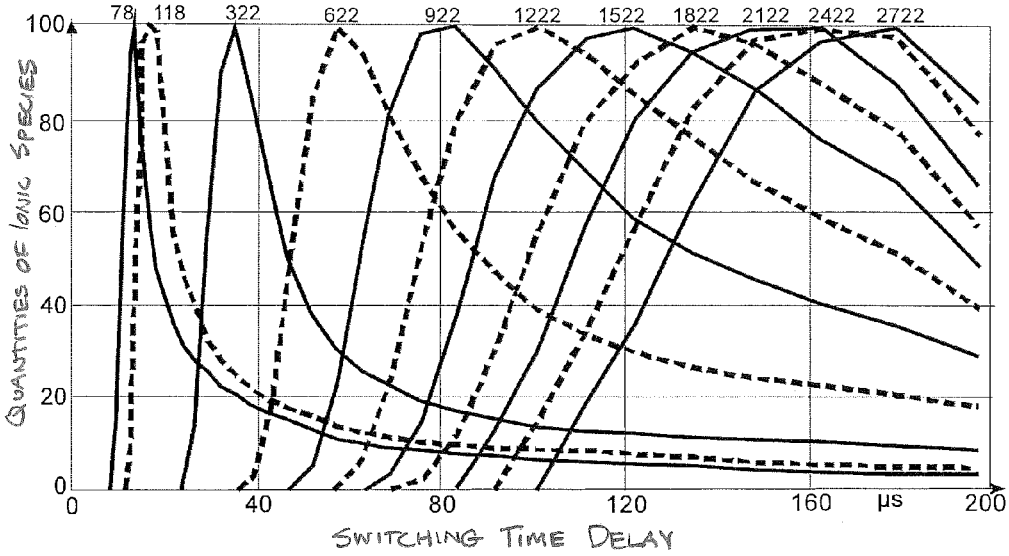
FIG. 2 shows measured values which were obtained with an arrangement as shown in FIG. 1. The measured quantities of the ionic species with 78, 113, 322, 622, 922, 1222, 1522, 1822, 2122, 2422 and 2722 dalton are shown as a function of the delay time (in microseconds) between the switching of the extraction lens and the switching of the ion pulser, normalized to their respective maximums. The ion storage device was closed again only shortly before the ion pulser was switched in order to also recognize the light ions in the individual spectra of the heavy ions, albeit with greatly reduced sensitivity. With a delay of around 160 microseconds, the ions of all masses can thus be measured simultaneously, but not all with maximum sensitivity; the light ions have already dropped to around 5 percent of their maximum value. At a delay time of 100 microseconds, ions can be recorded well in the mass range 900 Da<m/z<1500 Da. This range is ideal for peptide and protein analyses with electrospray ionization.
Figure 4A:
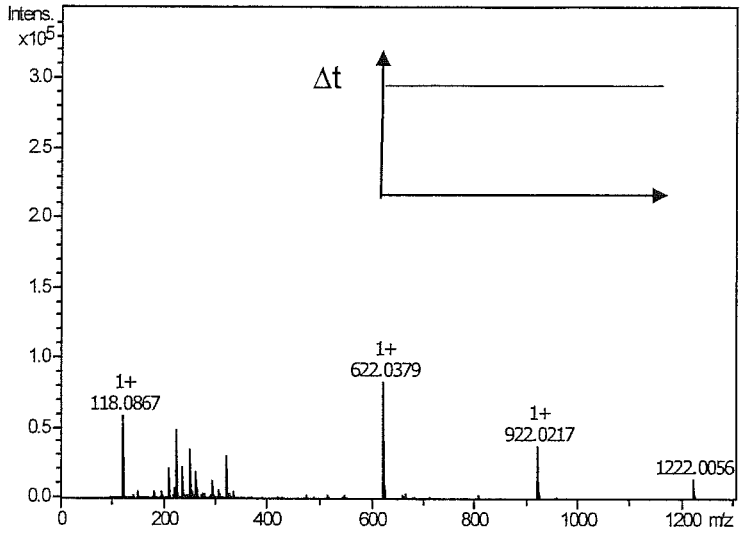
FIGS. 4A to 4C are graphical illustrations of sum spectra of a substance mixture acquired with a plurality of different delay times ($\Delta t$)
Figure 4B:
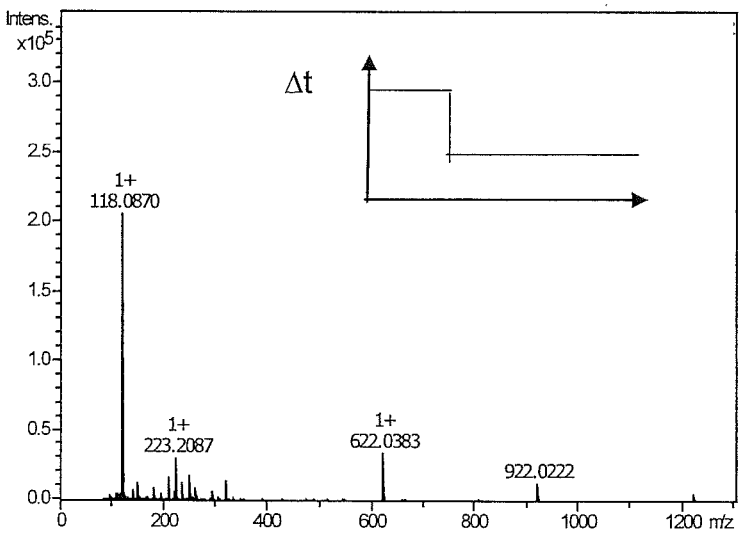
Figure 4C:
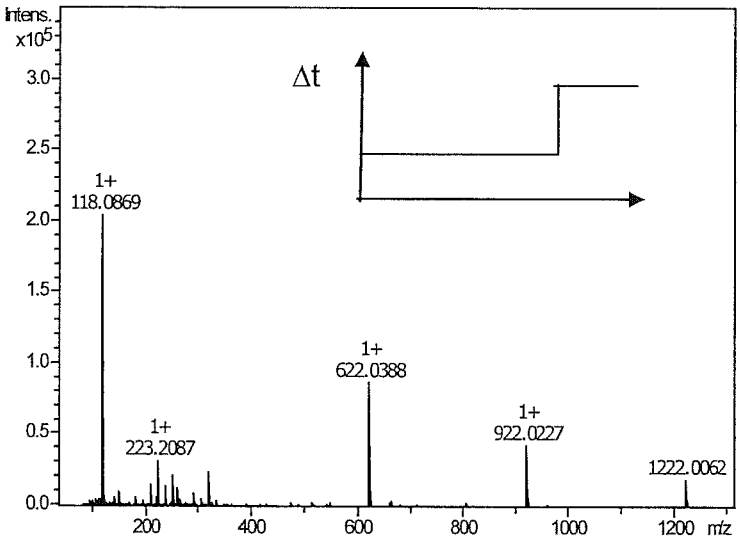

FIGS. 4A to 4C graphically illustrate sum spectra of a substance mixture acquired with a plurality of different delay times (Δt). The sum spectrum of FIG. 4A, for example, was acquired as a series of individual spectra, all with a relatively long delay time (e.g., Δt=70 μs). While there is a relatively high sensitivity for heavier ions of 622 Da, 922 Da and 1222 Da, the sensitivity is relatively low for light ions with m/z=118 Da, which are present in the mixture of the present example in a relatively high concentration. Referring to FIG. 4B, in contrast, the sensitivity for the heavier ions decreases by a factor of around 3 and the sensitivity for light ions increases by about a factor of 3 by, for example, acquiring a relatively short series of individual spectra with a relatively long delay time (e.g., Δt=70 μs) followed by a longer series of individual spectra with a shorter delay time (e.g., Δt=25 μs). Now referring to FIG. 4C, reversing the order of the two series (e.g., first shorter, then longer delay times), the sensitivities may be increased (e.g., optimized) for both the light and heavy ions. For the aforesaid examples, the ion storage device was emptied after each series with the two delay times during the spectrum acquisition. It should be noted, however, that these results would have been clearer had delay times of, for example, fifteen μs and eighty μs been applied as shown in FIG. 2.

In general, the numbers of ions of equal mass for acquiring an individual spectrum in an OTOF mass spectrometer should not be relatively large. For example, when a digitizing unit with a five gigahertz measuring rate and an eight bit measuring range is used, with which about every ion above the background noise is to be measured, an ion current peak should include less than approximately 1,000 ions of the same mass to prevent the measuring unit from being driven into an uncorrectable saturation. Measuring 1,000 ions of the same mass in an individual spectrum already uses special measures, which include being able to detect and compensate for saturations as taught in, for example, DE Application No. 10 2010 011 974, GB Application No. 2,478,820 and US Publication No. 2011/0226943. With a measuring time of one second and about 5,000 individual spectra per second, a sum spectrum may measure up to, for example, a maximum of 5,000,000 ions of the same mass. On the other hand, a peak in the sum spectrum may be evaluated if it is formed by only ten ions; e.g., when one single ion of a mass occurs only in one of every 500 individual spectra. Thus, the dynamic measuring range amounts to 1:500,000 despite the small number of ions in the individual spectra. The dynamic range may be increased where the time for the acquisitions of individual spectra for summing to a sum spectrum is increased.

Where a relatively large number of individual spectra of light ions are acquired, relatively few acquisitions of individual spectra of the heavy ions suffice because their quantity in the ion storage device decreases relatively quickly. It can be estimated that with a uniform, relatively low feed of ions into the ion storage device, the quantity of heavy ions has decreased to around half after 10 individual spectra with heavy ions; to a quarter after 20 individual spectra; to one eighth after 30 individual spectra. Therefore, p>>q should always be selected.

The number p of individual spectra of light ions is generally selected so that the heavy ions do not reach the saturation limit of the ion storage device as they collect the heavy ions. Where there is a relatively large number of ions in the ion storage device, the heavy ions get lost because they are pushed against the electrodes of the ion storage device by the space charge since the pseudopotential is weaker for them (e.g., proportional to z/m). As the number p increases (e.g., as the cumulative storage of heavier ions becomes longer), the number of heavier ions initially increases linearly, passes through a maximum, and then begins to decrease. The maximum is reached earlier for the medium-mass ions than for the heavy ions. The number p is generally selected so that during the subsequent acquisition of individual spectra of the heavy ions, the ions are not so numerous when they are extracted from the ion storage device that measuring them reaches the saturation limit of the ion detector.

The number q may be selected so that the number of heavy ions in the ion storage device in successive cycles of p and q individual spectra does not continue to increase, and the quantity of heavy ions is sufficiently diminished. The number q may be selected so that by acquiring the q individual spectra at least half (e.g., around three quarters to seven eighths) of the heavier ions collected are removed from the ion storage device, which increases measurement sensitivity. The ion storage device may be nearly or completely emptied once after several series of p and q individual spectra to prevent a cumulative collection of the relatively heavy ions above the mass range of the measurements. A space charge of such a cumulative collection of relatively heavy ions may also interfere with the operation of the ion storage device when filling and extracting.

In some embodiments, the numbers of p and q are relatively small in order to avoid space charge effects. The number p of individual spectra of light ions, for example, may be kept in the range of a few hundred instead of a few thousand spectra. It is even possible that the method may run with p=10 and q=2. It is favorable to occasionally empty the ion storage device completely since the ion storage device may otherwise continue to fill cumulatively with heavy ions that are not completely extracted. Before emptying the ion storage device, the accumulated quantity of heavier ions may be used beneficially for a measurement involving a series of, for example, q=20 or even q=30 individual spectra. The space charge in the ion storage device has an effect on the extraction process; e.g., if the space charge becomes too great, the mixture of extracted ions is changed.

The individual spectra are summed in the foregoing method to form a sum spectrum irrespective of the delay time. A plurality of partial sum spectra may alternatively be provided, however, by separately summing the p individual spectra of light ions over some or all of the cycles as well as the q individual spectra of heavy ions over some or all of the cycles. Such partial sum spectra may be used to measure mass spectra with a relatively high mass accuracy. The partial sum spectra may then be converted, using respective calibration curves, into listed mass spectra. The listed mass spectra may be recombined to give a final sum spectrum.

It is worth noting that mass accuracies of 0.2 ppm of the measured mass may be achieved using today's OTOF mass spectrometers. Measurements with such a high degree of mass accuracy, however, are susceptible to disturbances by changes of the acquisition conditions.

Referring to FIG. 1, the flight path of the ions may be shielded by an electrically conductive casing (not shown) between the switchable extraction lens 9 and the pulser 12 in order to reduce or prevent disturbances of the ion beam 11; e.g., to reduce the influence of electrical and magnetic interferences on the primary ion beam 11. An ion beam with ions of, for example, fifteen electron volts kinetic energy is exceptionally susceptible to disturbances and may be easily deflected. Such disturbances and deflection deteriorates mass accuracy and mass resolution of the mass spectra because the quality of the mass spectra depends on a relatively good and reproducible positioning of the primary ion beam 11 transiting the pulser 12. With a flight path of two meters, a positional shift of two micrometers shortens the flight distance by one millionth, which likewise changes the time of flight by one millionth and the mass calculated from it by two millionths (e.g., two ppm). It is worth noting, however, that a well-designed ion pulser may compensate for the effect of the positional shift, at least partially, by slightly lower acceleration of the ions.

The aforesaid method may also be extended to investigate a plurality of ranges of light ion masses and/or a plurality of ranges of heavy ions. For example, it is possible to first acquire 100 individual spectra each with delay times of 30, 25, 20, 15 and 10 microseconds, before 20 individual spectra with 100 microseconds delay time are measured. The method shown in FIG. 3, for example, covers the mass range of light ions of 100 to 300 daltons relatively well and still with high sensitivity, without negative effect on the sensitivity for heavy ions.

Where the mass discrimination of the ion storage device is relatively high, it may be advantageous to exploit the storage of the slightly heavier ions for the light ions. For example, the ion storage device may be closed again after a relatively short time, instead of closing it just before the ion pulser is switched. Rapid closure allows the slightly heavier ions with m/z=200 Da to be stored, for example during the acquisition series of 100 individual spectra of the light ions with m/z=80 Da with a delay time of ten microseconds. Subsequently around 20 individual spectra may be measured with a delay time of 20 microseconds with ions around the mass m/z=200 Da. After the ions with a mass of m/z=140 Da have then been measured with a further 100 individual spectra with a delay time of 15 microseconds, the ions of mass m/z=300 have accumulated so much that they may be measured with 20 individual spectra and a delay time of 28 microseconds. The ions in the range from 900 Da to 1500 Da may subsequently be measured with 20 individual spectra and a delay time of 100 microseconds. The fact that the ion storage device is only opened briefly means, however, that the light ions do not occur at all in the individual spectra of the heavier ions. The mass spectrum with the complete mass range therefore is provided by summation to form a sum spectrum.

Figure 5:
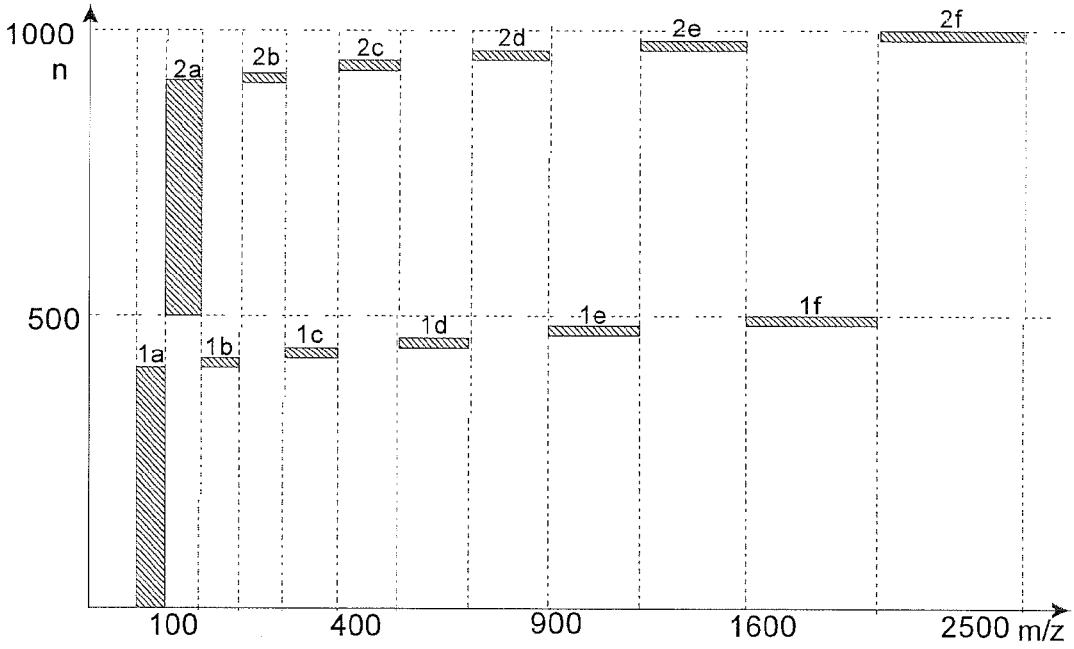
FIG. 5 is a graphical illustration of an acquisition arrangement that acquires a mass range from about 100 Da to over 2500 Da in two acquisition sequences 1*a* to 1*f* and 2*a* to 2*f*.

FIG. 5 illustrates an acquisition arrangement that acquires a mass range from about 100 Da to over 2500 Da during two acquisition sequences 1*a* to 1*f* and 2*a* to 2*f*. This acquisition arrangement may be used to obtain a substantially uniform measurement of all the ions in the aforesaid mass range. These measurements utilize rapid closing of the ion storage device after the ions of the mass range to be measured have exited from the ion storage device in sufficient numbers. The mass range of around 100 Da to more than 2500 Da is acquired here in two sequences of acquisitions: 1*a* to 1*f* and 2*a* to 2*f*. During the two first acquisition series 1*a* and 2*a*, each for example with 400 individual spectra for light ions, the heavy ions are collected for the respective subsequent acquisition series 1*b* to 1*f* and 2*b* to 2*f* to acquire 20 individual spectra each. Although the mass range is divided up into 10 intervals, almost 40 percent of the ions produced in the ion source during the complete acquisition time are measured in the 1,000 individual spectra. The two sequences of acquisitions each have gaps in the mass range so that, during measurement of the lighter ions in each case, the slightly heavier ions may be stored securely and without any losses by closing the ion storage device quickly.

Although the extraction of ions from a quadrupole ion storage device exhibits mass discrimination, it is by no means a "mass-selective ion trap" in EP 1 315 195 or U.S. Pat. No. 6,794,604 B2. The "mass-selective ion trap", for example, sends ions from mass ranges for the acquisition of an individual spectrum without significant portions of ions of other mass ranges also being sent. Alternatively, the "mass-selective ion trap" first send heavy and then light ions so that they arrive in the ion pulser simultaneously. These options do not exist here (unfortunately).

The OTOF mass spectrometer 100 of FIG. 1 may be used to perform the present method where the mass spectrometer 100 provides sufficiently fine control of the times at which the switchable extraction lens 9 on the ion storage 7 device is opened and closed. In general, the frequency at which the ion pulser 12 operates is maintained relatively constant in an OTOF-MS. The delay time is therefore really a "lead time", but because the literature conventionally uses the term "delay time", this term is retained herein. In order to set the delay time between the switchable extraction lens 9 and the ion pulser 12, the opening and closing of the switchable extraction lens is controlled at accurately determined times before the switching of the ion pulser 12.

The points in time for closing the extraction lens 9 after extraction of the desired ions depend on the processes within the ion storage device 7. It is possible to obtain an idea of these internal processes by subtracting the calculable flight times of the ions between the switchable extraction lens and the ion pulser from the (e.g., precisely defined) appearance times of the ions in the individual spectra (see FIG. 2). The times which the ions of different mass in the interior of the ion storage device need in order to reach the switchable extraction lens 9 after it has been opened may then be obtained. The flight times of the ions from the extraction lens to the ion pulser are around, for example, fifty percent shorter than the times of the ions within the ion storage device in order to reach the extraction lens. The flight to the pulser therefore takes about one third of the total delay time.

The individual spectra for light ions may not include any heavy ions. The individual spectra of the light ions are therefore much shorter in time and, thus, acquisition may be stopped after a relatively short time. It is thus possible, in principle, to acquire the light ions with a relatively high ion pulser frequency; e.g., 20 kilohertz instead of 5 kilohertz.

Using the present method with the time-of-flight mass spectrometer 100 of FIG. 1, it is possible to acquire spectra of the original ions of the ion source, and also spectra of daughter ions of selected parent ions after their fragmentation. In a first (e.g., normal) mode with temporary storage, the method for analyzing the original ions may be performed, for example, as described below.

In the ion source 1 with the spray capillary 2, ions are generated at atmospheric pressure by electrospraying, and these ions are introduced into the vacuum system through the capillary 3. The ion funnel 4 gathers and transfers the ions into the first RF quadrupole rod system 5, which is operated as a simple ion guide, and feeds the ions continuously through the entrance lens 6 and into the storage device 7. The storage device 7 has a gastight casing and is loaded with collision gas by the gas feeder 8 in order to dampen the ion motion via collisions and to collect the ions in the axis. The ions are extracted from the storage device 7 by the switchable extraction lens 9 at specified times. The lens 9, together with the other parts 10 of, for example einzel lens, shapes the ions into a fine primary beam 11 and sends them to the ion pulser 12. The aforementioned delay times may (e.g., always) relate to the time differences between the opening of the ion storage device 7, by switching the potentials at the extraction lenses 9 and 10, and the pulsed orthogonal acceleration of the ions in the ion pulser 12, by switching the potentials at the ion pulser 12. The ion pulser 12 pulses out a section of the primary ion beam 11 at right angles into the high-potential drift region 13, thus generating the new ion beam 14. The ion beam 14 is reflected in the reflector 15 with velocity focusing and measured in the detector 16. The mass spectrometer is evacuated by the pumps 17, 18 and 19. Using the present method, individual spectra acquired with different delay times are obtained so that heavy ions are collected (e.g., continuously) while light ions are being measured.

Where daughter ion spectra of selected parent ions are acquired with the present method, the parent ions are filtered out in the RF quadrupole rod system 5, which is now operated as a mass filter. The filtered parent ions are injected with an energy between, for example, around 30 and 60 electron volts (eV) into the ion storage device 7. In this process, the ions are fragmented by collisions with the collision gas in the ion storage device 7, and the individual spectra of the daughter ions may be acquired in analogy with the method above. The pressure of the collision gas may be, for example, between 0.01 and 10 pascal; e.g., an optimum pressure in the ion storage device 7 is around one pascal in order to achieve very fast damping of the ions with a time constant of, for example, around 10 to 100 microseconds.

The present method is not limited to a sample molecule ionization techniques and/or devices. The sample molecules may be ionized, for example, by matrix-assisted laser desorption (MALDI), either outside the vacuum system or inside the vacuum system (e.g., in front of the ion funnel 4 of FIG. 1), rather than the electrospray ion source 1. Since singly charged ions are produced by the MALDI ionization, it is important to measure the individual spectra in several mass ranges.

In order to extract the ions from the ion storage device 7 more quickly, a potential gradient may also be generated in the axis of the ion storage device 7. An example of such a potential gradient is disclosed in U.S. Pat. Nos. 6,111,250 and 7,164,125. A quadrupole and/or hexapole diaphragm stack may also be used, for example, as disclosed in D.E. Publication No. 10 2004 048 496, G.B. Publication No. 2,422,051 and U.S. Pat. No. 7,391,021. In these cases, the storage device may also be longer, since the internal electric field causes the ions to collect in front of the exit of the storage device. However, it has been found that an axial electric field causes the mass discrimination of the extraction process to become stronger, which means that the individual spectra acquired with a certain delay time each have an even smaller mass range.

To reduce the mass discrimination, a spatially short ion storage device 7 may be used because the ions of one mass may then flow out of the ion storage device more quickly and there is a greater overlap between ions of different masses. An RF quadrupole ion storage device 20 millimeters in length with an inner rod distance of six millimeters has proven to be favorable. When used in conjunction with favorably formed electric penetration fields of the potential of the extraction lens 9, the result is short extraction times with better overlapping of the ions of different masses. This embodiment of the present method, however, also mixes individual spectra with different delay times.

Although the present invention has been illustrated and described with respect to several preferred embodiments thereof, various changes, omissions and additions to the form and detail thereof, may be made therein, without departing from the spirit and scope of the invention.

What is claimed is:

1. A method for operating a time-of-flight mass spectrometer that includes an ion pulser and an ion storage device, the method comprising:

collecting ions in the ion storage device;

acquiring individual spectra of ions, where a first series of p individual spectra of light ions is acquired with a first delay time between the opening of the ion storage device and the acceleration pulse of the ion pulser while heavier ions are cumulatively gathered in the ion storage device, after which a second series of q individual spectra of heavier ions is acquired with a second delay time longer than the first delay time;

periodically emptying the ion storage device after the acquisition of the second series of q individual spectra, and summing the individual spectra to form a sum spectrum.

2. The method of claim 1, wherein the number p of the individual spectra of the light ions is greater than the number q of individual spectra of the heavier ions.

3. The method of claim 1, wherein the acquisition series of the p and the q individual spectra respectively are cyclically repeated a plurality of times until a full measuring time for the sum spectrum is reached.

4. The method of claim 1, wherein the number p of the individual spectra of the light ions is selected so that the heavier ions are collected for as long as possible without losses, but not for so long that, in the subsequently acquired individual spectra of the heavier ions, the heavier ions are extracted in such great numbers that the ion detection device reaches saturation.

5. The method of claim 1, wherein the number p of the individual spectra of the light ions is limited so that the collection of the heavier ions does not create a space charge in the ion storage device that obstructs extraction of the ions from the ion storage device.

6. The method of claim 1, wherein the number q of the individual spectra of the heavier ions is chosen so that at least half of the heavier ions collected during the acquisition of the p individual spectra of the lighter ions are extracted.

7. The method of claim 1, further comprising acquiring an additional series of individual spectra for ions of one or more other mass ranges.

8. The method of claim 7, wherein each time the ion storage device is opened, the ion storage device is closed again so that ions, which are slightly heavier than the ions just acquired, are cumulatively stored.

9. The method of claim 1, wherein the individual spectra, which are each measured with a certain delay time, are summed to form a partial sum spectrum in each case, the partial sum spectra are converted into partial mass spectra by associated calibration curves, and the partial mass spectra are combined into the sum mass spectrum.

10. The method of claim 1, wherein characteristics including at least one of voltage or frequency of an RF voltage at the ion storage device are altered to provide ions from the ion storage device.

11. A method for operating a time-of-flight mass spectrometer that includes an ion pulser and an ion storage device, the method comprising:

collecting ions in the ion storage device;

acquiring a series of p individual spectra of light ions with a first delay time between the opening of the ion storage device and an acceleration pulse of the ion pulser while heavier ions are cumulatively gathered in the ion storage device;

acquiring a second series of q individual spectra of heavier ions with a second delay time longer than the first delay time;

periodically emptying the ion storage device after the acquiring of the second series of q individual spectra, and summing the individual spectra to form a sum spectrum.

* * * * *